United States Patent [19]

Nardozzi, Jr.

[11] 4,027,596

[45] June 7, 1977

[54] RAPID TRANSIT SYSTEM

[76] Inventor: Michael A. Nardozzi, Jr., 255 Rushland Drive, Pittsburgh, Pa. 15235

[22] Filed: Oct. 17, 1975

[21] Appl. No.: 623,495

[52] U.S. Cl. ..... 104/138 R; 104/28; 104/35; 104/130; 104/242

[51] Int. Cl.[2] ..... B61B 13/10

[58] Field of Search ..... 104/27, 28, 30, 35, 104/88, 138R, 139, 242, 245, 246, 248, 130, 118, 119; 105/144, 141

[56] References Cited

UNITED STATES PATENTS

| | | | |
|---|---|---|---|
| 860,312 | 7/1907 | Moore | 104/248 |
| 916,531 | 3/1909 | Carr | 104/138 R X |
| 1,061,035 | 5/1913 | Batcheller | 104/138 R X |
| 1,281,119 | 10/1918 | Barraclough | 104/138 R |
| 1,700,640 | 1/1929 | Mangels | 104/130 UX |
| 2,657,642 | 11/1953 | Babcock | 104/28 |
| 3,403,634 | 10/1968 | Crowder | 104/138 R |
| 3,788,232 | 1/1974 | Schneider et al. | 104/88 |
| 3,859,925 | 1/1975 | Hartz | 104/88 |
| 3,906,866 | 9/1975 | Knippel | 104/245 X |

*Primary Examiner*—L. J. Paperner
*Assistant Examiner*—Randolph A. Reese
*Attorney, Agent, or Firm*—Stanley J. Price, Jr.; John M. Adams

[57] ABSTRACT

An enclosed roadway supported by a superstructure forms an endless transit loop on which vehicles are propelled for the mass transportation of passengers between selected stations in the transit loop. A stabilizing system maintains the vehicles on the roadway and includes a stabilizing track having recessed portions that are supported above and at opposite sides of the roadway. A circumferential bumper surrounds each vehicle and is positioned within the recessed portions of the stabilizing track. Braking apparatus mounted on the bumper are operable to frictionally engage the recessed portions of the stabilizing track to slow and stop the vehicle on the roadway. Traction motors mounted on the front and rearward end portions of each vehicle include drive shafts that support driven wheels on the upper surface of the stabilizing track for propelling the vehicle along the roadway. A guidance system controls movement of the vehicles on the roadway and includes a pair of spaced parallel guide rails positioned on the roadway and a guideway positioned in parallel relation between the guide rails on the roadway. Guide plates extend downwardly from the body portion of each vehicle into a recessed portion of the guideway to maintain guide wheels of each vehicle in contact with the guide rails. An additional feature includes a plurality of endless transit loops that radiate outwardly from a main terminal to provide transportation by the vehicles in a plurality of directions to and from the main terminal.

11 Claims, 14 Drawing Figures

RAPID TRANSIT SYSTEM

BACKGROUND OF THE INVENTION

1. Field of the Invention

This invention relates to a rapid transit system and more particularly to a rapid transit system for the mass transportation of passengers by the continuous movement of vehicles upon rails of an exclusive roadway that forms an endless transit loop.

2. Description of the Prior Art

Modern mass transit systems are well known in the art and are characterized by the automatic or attended operation of vehicles either singly or in multiple vehicle trains on an exclusive roadway in the form of a continuous loop having stations for passenger boarding and departing located at selected points in the loop. The roadway may comprise either single or double track sections elevated or located at grade level. The track sections may be supported by steel guide beams on concrete slabs for steering the vehicle on the roadway. The vehicles or multi-vehicle trains may be propelled by power rails or inductive wires feeding electric current to the electric motors of the vehicles. The transit systems generally include a guidance system which serves to maintain stability of the vehicles as they move from station to station on the exclusive roadway in the continuous loop.

Fully automated transit systems, such as the rapid transit system built by the San Francisco Bay Area Rapid Transit District (BARTD) and the Experimental Transit Expressway erected by Westinghouse Company in Allegheny County, Pennsylvania, operate vehicles singly or in multiple-vehicle trains at preselected intervals unidirectionally over an exclusive roadway. The experimental Transit Expressway is disclosed in The American Society of Mechanical Engineers, publication no. 67-WA/BHF-8, entitled *An Evaluation of an Automated Mass Transit System* in which rubber tired vehicles ride on concrete track slabs and are steered through vehicle guidance systems that follow a steel guide beam centered down the track of the roadway. Vehicle current collectors pick up power from energized rails located adjacent the track slab. Intelligence is conveyed to and from the vehicles by conductor wires laid along the inside of the track slab. With this arrangement the operation of the entire system is monitored and controlled remotely from a control center through electrical equipment located at the respective stations along the roadway and aboard the vehicles. A built-in-system of checks and interlocks operate to continuously monitor the system operation to detect malfunctions or failures in equipment. In the event of a malfunction or failure in equipment, all the vehicles are brought to a halt by an emergency stop procedure. Nevertheless, in the event a vehicle becomes disabled on the roadway, it is necessary to place operators on board to recover the vehicle.

U.S. Pat. No. 3,403,634 illustrates and describes an automatic transportation system having vehicles remotely controlled for effecting vehicle traffic between stations. This system includes a closed main loop arrangement with the vehicles traveling at a substantially uniform speed and automatically switched to and from preselected stations located on spur loops so that the traffic on the main loop is undisturbed. The enclosed loop comprises a stationary tubular elongated endless conduit that is adapted to be supported adjacent present transportation facilities. Vehicles run bumper to bumper in the closed loop at a generally high rate of speed with a minimum of space between the vehicles as determined by the demand placed upon the system. A car or vehicle may enter the main loop from a spur loop. A pair of longitudinal rails extend through the closed loop and include a C-shaped cross section. Rubber tired wheels of the vehicles engage the C-shaped rails. Rotation of the wheels through a drive means propels the vehicles on the tracks within the enclosed conduit loop. The drive mechanism comprises a squirrel cage induction motor having stator windings employed along the track and continuously excited by current therethrough to generate a magnetic wave which actuates a rotor of the motor placed on the vehicle to rotate the tires through the axle and provide constant thrust to the vehicles.

There is need for the mass transportation of passengers of vehicles that operate over an exclusive roadway in the form of a continuous loop. While it has been suggested to provide elaborate fully automated mass transit systems, the safeguards required for such a system render the system commercially unfeasible. Thus a mass transit system is needed that satisfies the problems presented by modern urban-suburban commutation in a safe and efficient manner but economically feasible.

SUMMARY OF THE INVENTION

In accordance with the present invention there is provided a rapid transit system for the mass transportation of passengers on a roadway that is supported by a superstructure at grade level and at elevations above grade level. A plurality of vehicles for transporting passengers to selected points on the roadway is supported for movement on the roadway. A stabilizing system secured to the superstructure and positioned above the roadway maintains the vehicles on the roadway. A guidance system is secured to the vehicles and is mounted on the roadway to guide the movement of the vehicles on the roadway. Each vehicle is provided with propelling mechanisms that engage the stabilizing system and are operable to generate horizontal movement of the vehicles on the roadway. Each vehicle is provided with a braking apparatus that is operable to engage a portion of the stabilizing means positioned above the roadway to control the rate of movement of the vehicle on the roadway.

The roadway is surrounded by an enclosure to protect the vehicles against the effects of weather and the entrance of obstructions upon the roadway. A plurality of enclosed roadways may be arranged in transit loops that radiate outwardly from a main terminal in selected directions to direct vehicle traffic between selected points in each transit loop to and from the main terminal. A rotatable section of the roadway located at the main terminal for each transit loop permits a change of direction of the vehicles on the roadway so that the vehicles may be directed away from the main terminal to complete another circuit of the transit loop.

Each vehicle is maintained on the roadway by the stabilizing system that includes a pair of parallel stabilizing tracks that are supported by the superstructure at a preselected height above the roadway. The stabilizing tracks include recess portions that receive a circumferential bumper that surrounds each vehicle and extends horizontally above the roadway. Roller members may be secured to the lower portion of the track recesses or on the bumper to support the bumper within the track recess to permit movement of the vehicles on the roadway. The guidance system for controlling movement of the vehicles on the roadway includes a pair of spaced parallel rails that are supported on the roadway. Guide wheels extend downwardly from the vehicles and are rotatably positioned on the upper surface of the guide tracks. The guide wheels are maintained in contact with the guide rails by guide plates that extend downwardly from the vehicle between the guide wheels and are retained within a guideway that is secured to the roadway and positioned in parallel relation between the guide rails. With this arrangement, the vehicle is securely retained on the roadway.

The vehicles are advanced on the roadway by operation of electric motors that are mounted at the front and rearward portions of the vehicles. Drive shafts extend outwardly from the electric motors, and wheels are nonrotatably secured to the drive shafts and engage the upper surface of the stabilizing tracks. Electric power is supplied from an overhead inductive wire to the electric motors to rotate the drive shafts and wheels and thereby propel the wheels on the surface of the stabilizing tracks and advance the vehicles over the roadway.

Accordingly the principle object of the present invention is to provide a rapid transit system for the mass transportation of passengers on a roadway that is constructed in an endless enclosed loop around which vehicles are propelled for transporting passengers between selected points of the transit loop Another object of the present invention is to provide a rapid transit system that transports passengers between stations of an enclosed endless transit loop in self-propelled vehicles that are maintained on the roadway of the transit loop by a stabilizing track with the direction of travel controlled by a guidance system.

A further object of the present invention is to provide a rapid transit system that is economically feasible and efficiently operated to move passengers on an exclusive roadway in self-propelled vehicles that travel in an endless transit loop on the roadway.

These and other objects of this invention will be more completely disclosed and described in the following specification, the accompanying drawings and the appended claims.

DESCRIPTION OF THE PREFERRED EMBODIMENTS

Figure 1:
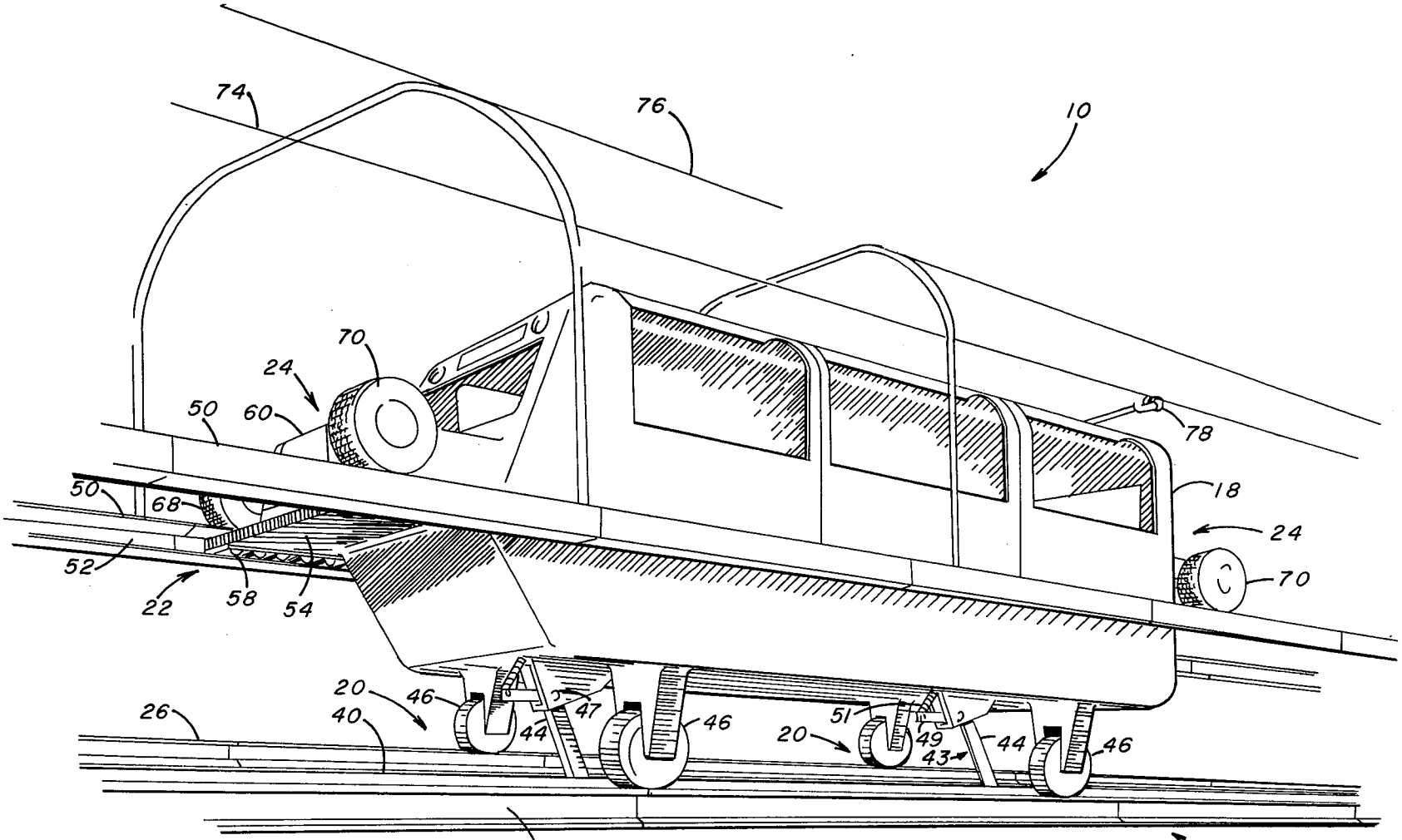
FIG. 1 is a prospective view of a self-propelled vehicle positioned on an enclosed roadway for travel between stations of a transit loop.

Referring to the drawings and more particularly to FIGS. 1–4, there is illustrated a mass transit system generally designated by the numeral 10 for the rapid movement of passengers within an enclosed transit loop 12 between stations 14 located at preselected points in the loop 12. The enclosed transit loop 12 includes an exclusive right-of-way represented by a roadway 16 upon which a plurality of vehicles 18 are self-propelled to and from the stations 14. The vehicles 18 are guided on the roadway 16 by a guidance system generally designated by the numeral 20 and are maintained on the roadway 16 by a stabilizing system generally designated by the numeral 22. The vehicles 18 are advanced on the roadway 16 by propelling mechanisms generally designated by the numeral 24. The propelling mechanisms are mounted at the front and rearward end portions of the vehicles 18 and engage the top surface of the stabilizing system of the roadway 16. In this manner forward movement of the vehicles 18 is accomplished so that the vehicles may be advanced from station to station on the enclosed transit loop 12 of the transit system illustrated in FIG. 4.

Figure 2:
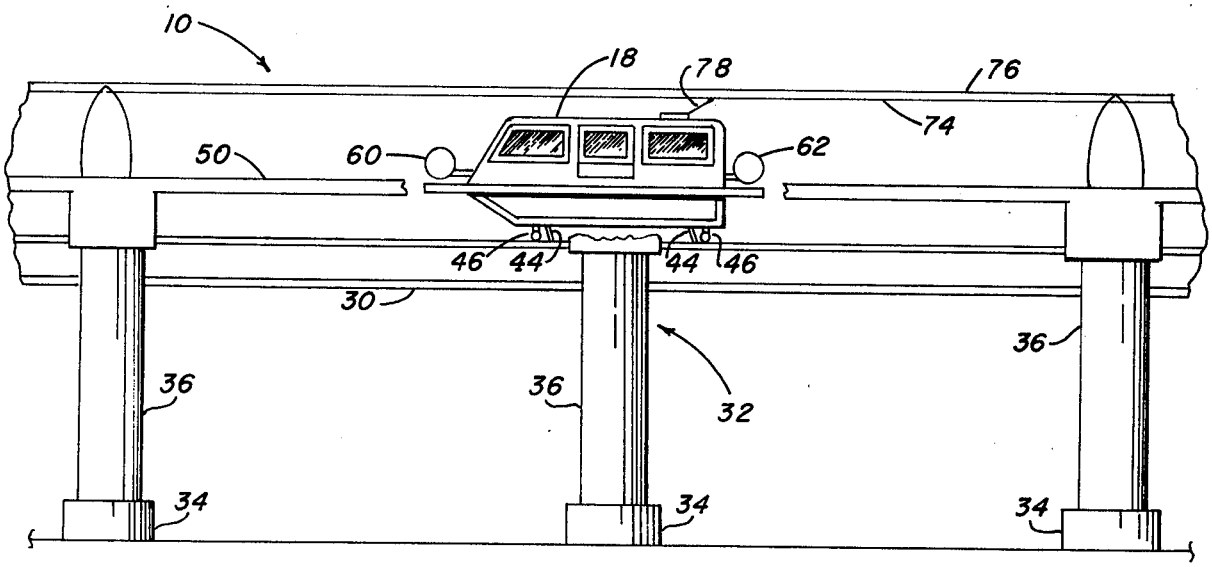
FIG. 2 is a side elevation of the transit system, illustrating a vehicle positioned on the roadway that is elevated above grade by a superstructure.
Figure 3:
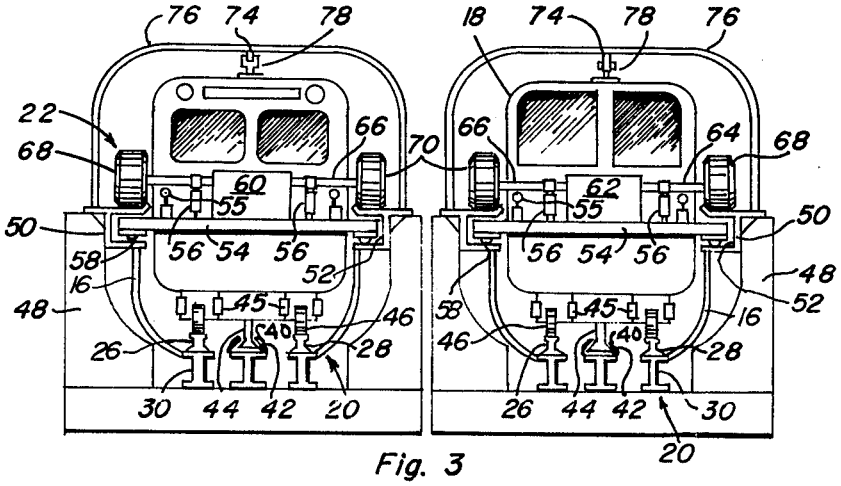
FIG. 3 is a fragmentary view of the roadway partially in section, illustrating the front end of one vehicle and the rearward end of another vehicle with the vehicles traveling in parallel relation on the tracks of the roadway within the transit loop.

The enclosed loop 12 of the transit system 10 may include a pair of spaced parallel roadways separated from one another as illustrated in FIG. 3. Each of the roadways 16 includes the guidance system 20 having a pair of spaced parallel tracks 26 and 28 that are supported by horizontally positioned I-beams 30. The beams 30 are supported by a steel superstructure generally designated by the numeral 32 and illustrated in FIG. 2. The steel superstructure 32 supports the roadway 16 at grade or elevated above grade as illustrated in FIG. 1. The steel superstructure 32 includes a plurality of pedestals 34 that are anchored in the ground and a rectangular steel column 36 supported and secured to each of the pedestals 34. Columns 36, in turn, support the I-beams 30.

A guideway 40 of the guidance system 20 is supported by an I-beam 30 in parallel relation between the guide tracks 26 and 28. The guideway 40 has a recess 42 in which is positioned the lower expanded portions of guide plates 44 that are resiliently secured by spring mechanisms 43 and shock absorbers 45 to the body portion of the vehicle 18.

The spring mechanisms 43 include a pivotal connection 47 between the body portion of the vehicle and the guide plate 44. A horizontal member 49 is connected to pivot 47, and a spring member 51 is secured at one end portion to member 49 and at the other end to the bottom of the vehicle. The spring 51 exerts an upward force upon member 49 to maintain the guide plate 44 within the guideway recess 42. Also, extension of spring 51 permits the guide plate 44 to pivot rearwardly above the connection 47. The vehicle 18 is supported by guide wheels 46 upon the upper surface of guide tracks 26 and 28. With this arrangement the vehicles 18 are stabilized for high speed travel on the roadway 16.

Figure 12:
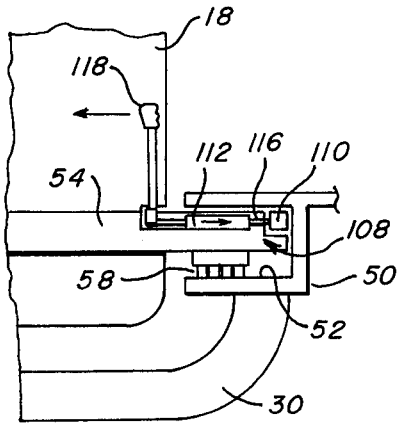
FIG. 12 is an enlarged fragmentary view in side elevation of another embodiment of the braking apparatus provided on each vehicle, illustrating an actuator for engaging the brake shoe with the roadway guide track for stopping the vehicle on the roadway.

As illustrated in FIG. 3, the roadway 16 includes sidewalls 48 that extend upwardly from the I-beams 30 and have horizontal upper surfaces upon which is positioned the stabilizing system 22 for maintaining the vehicles 18 on the roadway 16. The stabilizing system 22 includes a C-shaped stabilizing track 50 having parallel horizontal recesses 52 that are positioned at a preselected height above the roadway 16. A circumferential bumper 54 extends around and is secured to the body portion of the vehicles 18 by shock absorbers 55. The lateral edge portions of the bumper 54 are positioned within the track recesses 52 and rest upon rollers 58 that are secured to the lower horizontal surface of the stabilizing tracks 50. With this arrangement the vehicles 18 are stabilized as they are propelled along the roadway 16 and at the respective stations for passenger boarding and departing. In another embodiment, as illustrated in FIGS. 1 and 12, the rollers 58 are secured to the lower surface of the bumper 54 for rotation on the lower horizontal surface of the stabilizing track 50 as the vehicles 18 are propelled along the roadway 16.

As illustrated in FIGS. 1–3, the vehicles 18 are advanced on roadway 16 by operation of the propelling mechanism 24 that is provided on each of the vehicles. The propelling mechanism includes front and rear traction motors 60 and 62 that are supported above the bumper 54 and project outwardly from the end portions of the vehicle. The traction motors 60 and 62 preferably are electric motors having drive shafts 64 and 66 that are rotated by the motors and have at their end portions nonrotatably secured thereto rubber tired wheels 68 and 70. The drive shafts 64 and 66 are supported on the vehicle body portion by shock absorbers 56.

Electric power is supplied to the traction motors 60 and 62 by an inductive wire 74 that extends above the roadway 16 within an enclosure 76 that surrounds the upper portion of the roadway 16. The enclosure 76 extends upwardly from the stabilizing track 50 and has curved side portions that conform to the configuration of the vehicles 18. The enclosure 76 may be fabricated from a suitable material, such as plexiglass and steel. The enclosure 76 functions to enclose the roadway 16 to prevent collection of debris thereon and permit temperature control within the enclosed transit loop 12. The inductive wire 74 extends the length of the transit loop 12 and a suitable electrical connection 78 provided on each vehicle remains in contact with the wire 74 to provide current flow from the wire to the traction motors 60 and 62. Also electrical power is supplied to the vehicles from the inductive wire 74 for the purpose of opening and closing doors, providing light, air-conditioning and operating the other electrical equipment on each vehicle.

Figure 4:
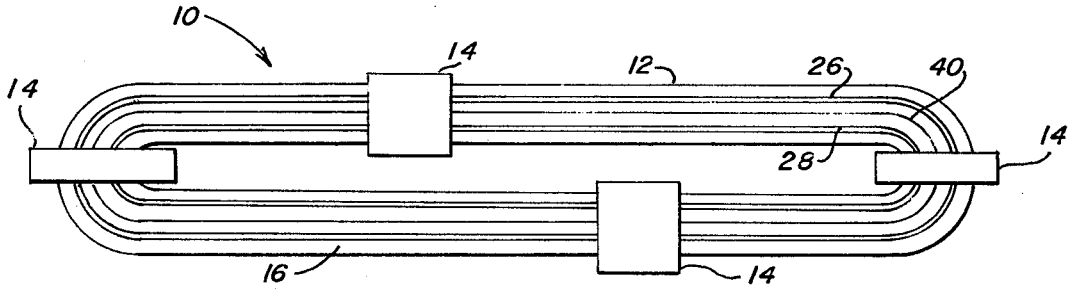
FIG. 4 is a top plan view of the enclosed loop of the rapid transit system, illustrating the stations located at selected points in the loop for the boarding and departing of passengers to and from the vehicles that circulate around the loop.
Figure 5:
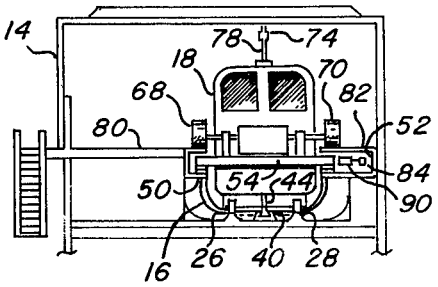
FIG. 5 is a front view of a vehicle positioned on the roadway in a station of the enclosed transit loop to permit the boarding and departure of passengers to and from the vehicle.

As illustrated in FIGS. 4 and 5, the roadway 16 of the enclosed transit loop 12 passes through the stations 14 where passengers board and depart the vehicles. Platforms 80 and 82 are positioned above the roadway 16 in each station 14 and extend adjacent to the stabilizing track 50 to permit boarding and departure of the passengers to and from the vehicles. A braking mechanism generally designated by the numeral 84 is provided on the stabilizing track 50 in each station 14 to effect stopping of the vehicles on the roadway 16 at each station.

Figure 6:
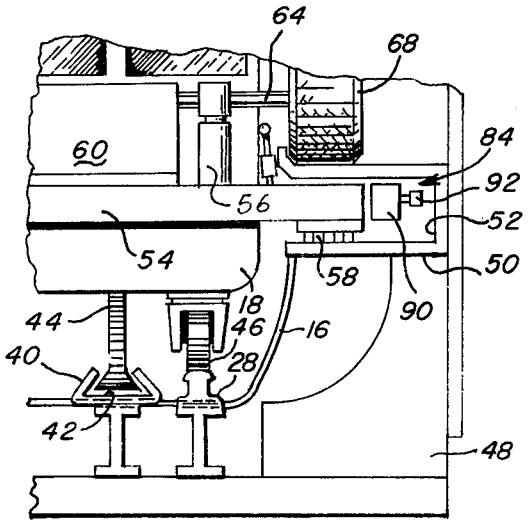
FIG. 6 is an enlarged fragmentary view of the front end portion of the vehicle illustrating the braking apparatus for stopping the vehicle in the transit loop.

The braking mechanism 84 illustrated in FIGS. 5 and 6 includes a braking shoe or bar 90 that is pivotally connected at one end portion to the stabilizing track 50 within a recess 52. The opposite end portion of the braking bar 90 is connected to an actuator device 92. Operation of the actuator device 92 urges the braking bar to pivot about its connection to the stabilizing track 50 so that the end portion of the braking bar extends into the path of the vehicle to obstruct the movement of the vehicle as it approaches the station 14. In this manner the vehicle is slowed and eventually brought to a stop at the station.

Figure 11:
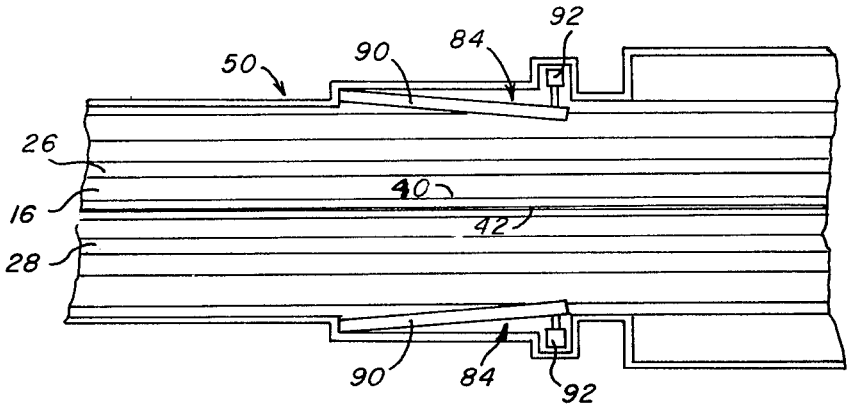
FIG. 11 is a top plan of the braking apparatus provided on the roadway for slowing the vehicles as they approach a station.

Not only may the stabilizing track 50 be provided with a braking mechanism at each station 14 but additional braking mechanisms 84 may be located at selected points along the roadway 16 for slowing and stopping the vehicles as illustrated in FIG. 11. The braking mechanism 84 illustrated in FIG. 11 includes a braking shoe or bar 90 that is pivotally connected at one end portion to the stabilizing track 50 within a recess 52. The opposite end portion of the braking bar 90 is connected to an actuator device 92. Thus, operation of the actuator device 92 pivots the braking shoe 90 about its connection to the stabilizing track 50 to urge the braking shoe 90 into the path of the approaching vehicle to engage the body portion of the vehicle, specifically the bumper 54, to slow and stop the vehicle on the roadway 16. In this manner, the speed of the vehicles may be controlled on grade portions of the roadway 16 and approaches to the stations 14.

Figure 7:
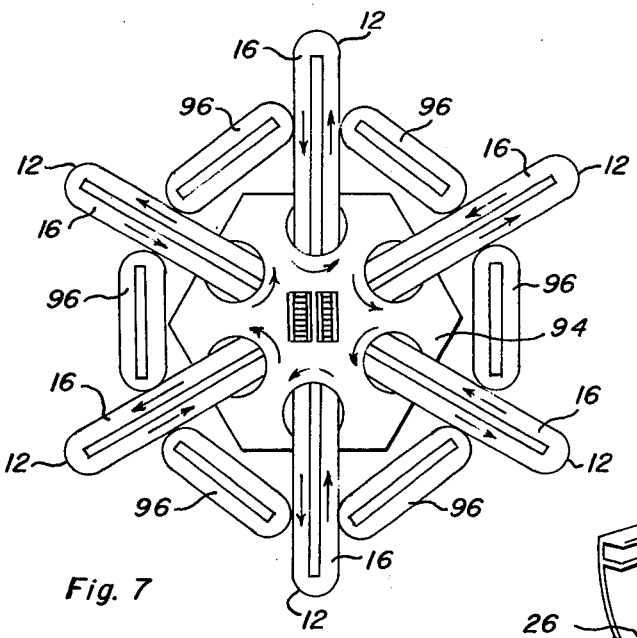
FIG. 7 is a schematic representation of a plurality of transit loops radiating outwardly from a main terminal for the mass transportation of passengers to and from the main terminal with trunk loops interconnecting the main loops.

In accordance with the embodiment of the present invention illustrated in FIG. 7, a plurality of enclosed transit loops 12 comprising the roadways 16 radiate outwardly in selected directions from a main terminal 94. With this arrangement, the transit loops 12 permit continuous movement of the vehicle 18 on the respective roadways 16 to and from the main terminal 94. The transit loops 12 may be interconnected by trunk lines 96 to permit transportation of passengers between stations in transit loops 12. A plurality of substations (not shown) may be provided in each of the enclosed transit loops 12 for the boarding and departing of passengers at selected points in the loops 12. Each substation may be interconnected to accommodate transportation between substations or transportation between substations and the main terminal 94 and substations in the trunk lines 96.

Figure 9:
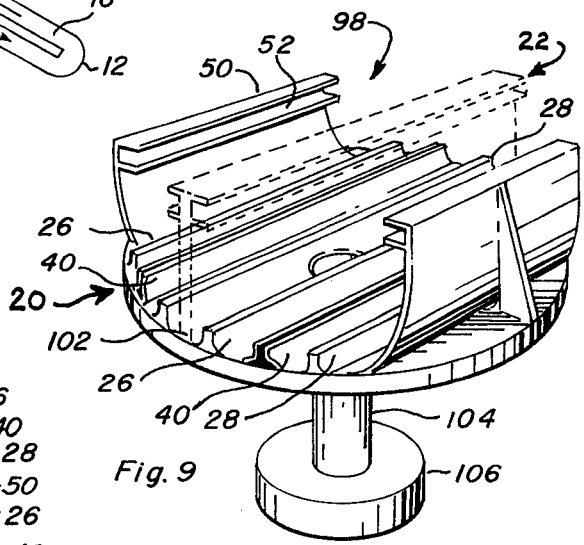
FIG. 9 is a perspective view of the rotatable roadway section illustrated in FIG. 8.
Figure 8:
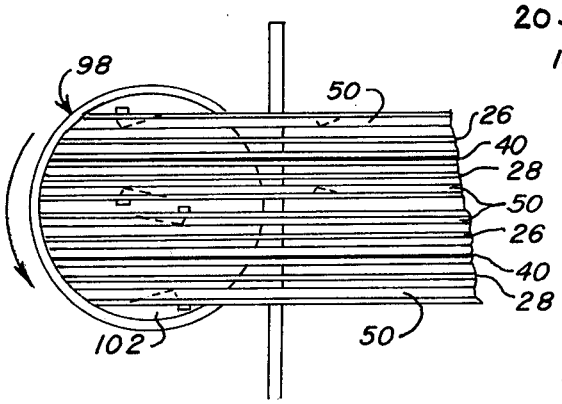
FIG. 8 is an enlarged fragmentary view of a rotatable section of the roadway for each transit loop as shown in FIG. 7, illustrating the direction of rotation of the rotatable section to reverse the direction of travel of the vehicles in the loop.
Figure 10:
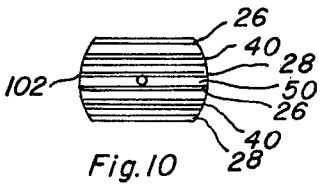
FIG. 10 is a fragmentary top plan view, illustrating the rotatable roadway section shown in FIG. 9.

Once the vehicles 18 have completed a run on one of the transit loops 12, illustrated in FIG. 7, and they return to the main terminal 94, a rotatable mechanism generally designated by the numeral 98 and illustrated in FIGS. 8–10 is provided for each transit loop at the terminal 94 for changing direction of the vehicles on the roadway 16 within the main terminal 94. The rotatable mechanism 98 may also be located at intermediate points of a transit loop 12 for short runs to and from the main terminal. The rotatable mechanism 98 includes a section 102 of the guidance system 20 having pairs of guide tracks 26 and 28 and guideways 40 for traffic movement in opposite directions on the roadway 16 and a section of the stabilizing track 50 extending upwardly from the guidance system 20. The center section on the stabilizing track 50 is shown in phantom in FIG. 9 for purposes of illustration. The rotatable section 102 is supported for rotation on the superstructure 32 by a drive shaft 104 that is drivingly connected to a motor 106. In operation, when a vehicle 18 has returned to the main terminal 94 and brought to a stop by operation of the braking mechanism 84, the rotatable section 102 is rotated through an angle of 180° in the direction indicated by the arrow in FIG. 8 to realign the section 102 with the roadway guidance system 20. The vehicle may then procede in the opposite direction on the roadway 16 to complete another run on the transit loop 12.

Figure 13:
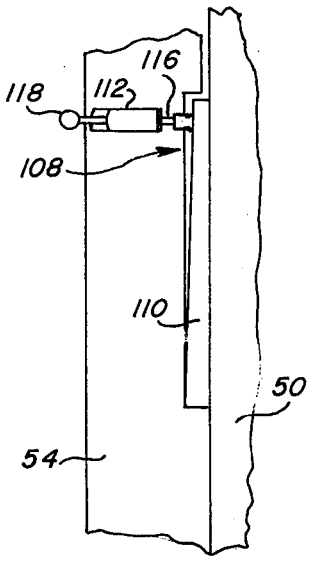
FIG. 13 is a top plan view of the braking apparatus shown in FIG. 12, illustrating a braking shoe pivotally connected to the vehicle for engagement with the guide track of the roadway.

In addition to the braking mechanism 84 illustrated in FIGS. 5, 6 and 11 that is provided within the recesses 52 of the stabilizing track 50, each vehicle is provided with a braking mechanism generally designated by the numeral 108 and illustrated in the FIGS. 12 and 13. The braking mechanism 108 includes a brake shoe 110 that is pivotally connected at one end to the vehicle 18 within the track recess 52. The free end portion of the brake shoe 110 is secured to a piston cylinder assembly 112 by a piston rod 116 that extends outwardly from the assembly 112. Actuation of the piston cylinder assembly 112 by hand lever 118 pivotally connected to the assembly 112 extends and retracts piston rod 116 to move the brake shoe 110 into and out of frictional engagement with the stabilizing track 50.

Movement of the hand lever 118 in the direction indicated by the arrow in FIG. 12 advances the piston within the assembly 112 to extend the piston rod 116 outwardly and urge the free end portion of brake shoe 110 into frictional engagement with the stabilizing track 50. In this manner, the forward motion of the vehicle 18 on the roadway 16 is retarded, and accordingly the vehicle 18 may be brought to a halt. The braking mechanism 108 may be provided on both sides of the vehicle 18 to provide for uniform stopping of the vehicle on the roadway to assure stability of the vehicle as it is brought to a stop.

Figure 14:
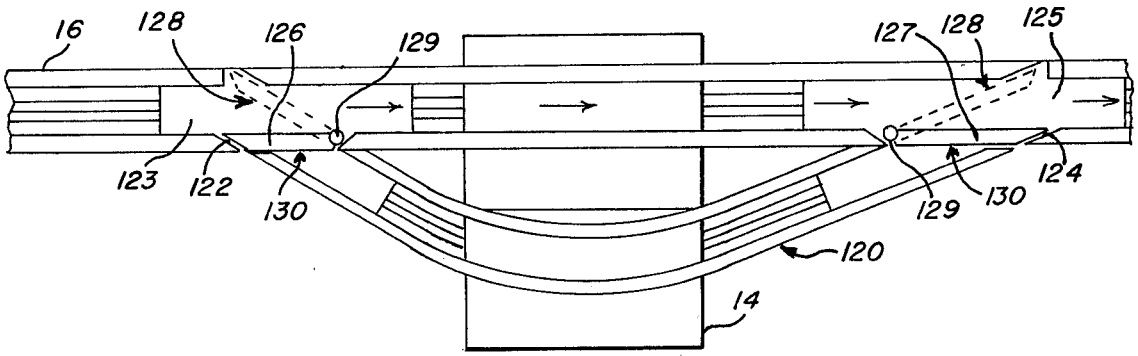
FIG. 14 is a top plan schematic view of a shunting track located at a station for diverting vehicle traffic to and from the main roadway through the station.

Further in accordance with the practice of the present invention, a shunting track generally designated by the numeral 120 and illustrated in FIG. 14 may be provided at each station 14 on the enclosed transit loop 12 for diverting vehicle traffic approaching a station to and from the portion of the roadway 16 that passes through a station. The shunting track 120 includes an entrance 122 from section 123 of roadway 16 and an exit 124 to section 125 of roadway 16. The roadway sections 123 and 125 are planar surfaces having the guide tracks 26 and 28 and guideways 40 removed. Pivotal gates 126 and 127 of the stabilizing track 50 provide access to and from the shunting track 120. Each of the pivotal gates is arranged to pivot about a vertical axis 129 to the roadway 16 between a first position 128, indicated in phantom in FIG. 14, for diverting traffic to and from the shunting track 120 and a second position 130 for continuing traffic flow on the roadway 16 through the station 14.

When the pivotal gates 126 and 127 are aligned in the second position 130, the vehicle traffic bypasses the shunting track 120 and is directed through the station 14 on the roadway 16. Accordingly, the vehicles are diverted from the roadway 16 onto the shunting track 120 and around station 14 when the pivotal gates 126 and 127 are aligned in the first position 128. Moving the gates 126 and 127 from the first position 128 to the second position 130 resumes traffic flow through the station 14 on the roadway 16. Thus, by selectively pivoting the gates 126 and 127 into and out of alignment with the roadway 16, it is possible to provide continuous movement of vehicle traffic around the station to facilitate an express run or to divert vehicles from the roadway 16 for temporary storage on the shunting track 120.

According to the provisions of the patent statutes, I have explained the principle, preferred construction and mode of operation of my invention and have illustrated and described what I now consider to represent its best embodiments. However, it should be understood that within the scope of the appended claims the invention may be practiced otherwise than as specifically illustrated and described.

I claim:

1. A rapid transit system for the mass transportation of passengers comprising, a roadway, a superstructure for supporting said roadway at grade level and at elevations above grade level, a plurality of vehicles for transporting passengers between selected points on said roadway, said vehicles each supported for movement on said roadway and having a body portion with a lateral portion being secured to and extending therearound, stabilizing means secured to said superstructure and positioned above said roadway for maintaining said vehicles on said roadway by movably supporting said lateral portion of said body portion of each of said vehicles, guidance means including a guide plate secured to and extending downwardly from said vehicle body portion and a recessed means mounted on said roadway for receiving said guide plate for controlling movement of said vehicles on said roadway, propelling means mounted on said vehicles and having means for engaging said stabilizing means for generating movement of each of said vehicles on said roadway, and braking means connected to each of said vehicles and operable to move into and out of frictional engagement with a portion of said stabilizing means to control the rate of movement of said vehicles on said roadway.

2. A rapid transit system for the mass transportation of passengers as set forth in claim 1 which includes, a plurality of stations for passenger boarding and departing said vehicles on said roadway, said stations located as selected points on said roadway, boarding and departing platforms extending outwardly from each of said stations adjacent said roadway, said stabilizing means including a stabilizing track having a pair of parallel spaced, horizontal recesses positioned a preselected height above said roadway, a braking bar pivotally connected at one end portion to said stabilizing track within said recesses at selected points along said stabilizing track and at each of said stations, and actuator means connected to the opposite end portion of said braking bar for urging said braking bar upon actuation into frictional engagement with said vehicle body portion to bring said vehicle to stop on said roadway and adjacent said boarding and departing platforms of said stations.

3. A rapid transit system for the mass transportation of passengers as set forth in claim 1 which includes, a main terminal for passenger boarding and departing, a plurality of said roadways forming endless transit loops radiating in selected directions from said main terminal to provide transportation between a plurality of points on said transit loops and said main terminal, a transparent enclosure extending upwardly from said roadways to enclose said transit loops, a plurality of rotatable sections rotatably supported by said superstructure, said rotatable sections each including pairs of guide tracks aligned with said guidance means mounted on said roadway and having guideways positioned between said respective pairs of guide tracks for receiving said guide plate of each of said vehicles.

stabilizing tracks extending upwardly from said guide tracks on opposite sides thereof and between said guide tracks, said stabilizing tracks having horizontal recesses for movably supporting said vehicle body portions as said vehicles are propelled through said rotatable sections, power means connecting said rotatable sections to said superstructure for rotating said rotatable sections relative to said superstructure to facilitate a change of direction of said vehicles on said roadway, and said rotatable sections located at the end of each of said transit loops, at said main terminal and at selected points therebetween.

4. A rapid transit system for the mass transportation of passengers as set forth in claim 3 which includes, interconnecting transit loops joining said endless transit loops for transporting passengers therebetween.

5. A rapid transit system for the mass transportation of passengers as set forth in claim 1 in which said stabilizing means includes, a circumferential bumper surrounding each of said vehicles, a stabilizing track supported by said superstructure above said roadway, said stabilizing track having parallel recessed portions selected at a preselected height above said roadway and at opposite sides thereof, and said circumferential bumper being positioned within said stabilizing track recessed portions to maintain stability of said vehicles while moving on said roadway and stationarily positioned on said roadway for passenger boarding and departing.

6. A rapid transit system for the mass transportation of passengers as set forth in claim 1 in which said guidance means includes, a pair of guide rails positioned in spaced parallel relation on said roadway, said recessed means including a guideway secured to said roadway and positioned in parallel relation between said pair of guide rails, said guideway having a recessed portion, guide wheels secured to and extending downwardly from each of said vehicles, said guide wheels rotatably supported on the upper surface of said guide rails to support said vehicles for movement thereon, and said guide plate resiliently secured to and extending downwardly from each of said vehicles, said guide plate having a lower portion positioned within said guideway recessed portion to maintain the direction of travel of said vehicles on said roadway.

7. A rapid transit system for the mass transportation of passengers as set forth in claim 1 in which said braking means includes, a brake shoe pivotally connected at one end to said body portion of each of said vehicles adjacent said stabilizing means, power means positioned on each of said vehicles and connected to the opposite end of said brake shoe for moving said brake shoe into and out of frictional engagement with said stabilizing means to effect stopping of said vehicles on said roadway, and means provided on each of said vehicles and connected to said power means for actuating said power means.

8. A rapid transit system for the mass transportation of passengers as set forth in claim 1 which includes, said stabilizing means including a stabilizing track having a pair of parallel spaced, horizontal recesses positioned a preselected height above said roadway, a braking bar pivotally connected at one end portion to said stabilizing means within said recesses at selected points along said stabilizing track, actuator means connected to the opposite end portion of said braking bar, and said actuator means extending outwardly from said stabilizing means and operable to move said braking bar into and out of frictional engagement with said vehicle body lateral portion and thereby control the rate of speed of said vehicles.

9. A rapid transit system for the mass transportation of passengers as set forth in claim 1 which includes, a plurality of stations for passenger boarding and departing said vehicles on said roadway, said stations located at selected points on said roadway, a shunting track for diverting vehicles approaching said stations from said roadway and around the section of said roadway passing through said station to provide continuous uninterrupted flow of traffic through said stations, openings in said roadway for the movement of said vehicles between said roadway and said shunting track, said stabilizing means including a stabilizing track having a pair of parallel spaced, horizontal recesses positioned a preselected height above said roadway, and portions of said stabilizing track pivotally positioned in said openings between said roadway and said shunting track for pivotal movement between a first position directing vehicle traffic from said roadway onto said shunting track and a second position closing said shunting track from vehicle traffic.

10. A rapid transit system for the mass transportation of passengers as set forth in claim 1 in which said propelling means includes, traction motors mounted on the front and rearward end portions of each of said vehicles, each of said motors having rotatable drive shafts extending outwardly therefrom, drive wheels nonrotatably connected to the end portions of each of said drive shafts, said stabilizing means having a stabilizing track, said stabilizing track having a first surface for rotatably supporting said drive wheels and a second surface positioned in spaced parallel relation with said first surface, said lateral portion of said body portion of each of said vehicles having a plurality of rollers secured thereto, said lateral portion positioned relative to said stabilizing track such that said rollers rotatably engage said stabilizing track second surface, and said traction motors operable upon actuation to rotate said drive wheels through said drive shafts on said first surface of said stabilizing track and thereby propel said vehicles on said roadway.

11. A rapid transit system for the mass transportation of passengers comprising, a roadway, a superstructure for supporting said roadway at grade level and at elevations above grade level, a plurality of vehicles for transporting passengers between selected points on said roadway, said vehicles supported for movement on said roadway, a circumferential bumper surrounding each of said vehicles, a stabilizing track supported by said superstructure above said roadway, said stabilizing track having parallel recessed portions positioned at a preselected height above said roadway and at opposite sides thereof, said circumferential bumper being positioned within said stabilizing track recessed portions to maintain stability of said vehicles while moving on said roadway and stationarily positioned on said roadway for passenger boarding and departing, guidance means secured to said vehicles and mounted on said roadway for guiding movement of said vehicles on said roadway, propelling means mounted on said vehicles and engaging said stabilizing track for generating movement of each of said vehicles on said roadway, and braking means provided on each of said vehicles for frictionally engaging a portion of said stabilizng track to control the rate of movement of said vehicles on said roadway.

* * * * *